US005778929A

United States Patent [19]

Ishizaki et al.

[11] Patent Number: 5,778,929

[45] Date of Patent: Jul. 14, 1998

[54] DIRECTIONAL CONTROL VALVE ASSEMBLY HAVING A PRESSURE COMPENSATION VALVE

[75] Inventors: Naoki Ishizaki; Mitsumasa Akashi, both of Tochigi-ken, Japan

[73] Assignee: Komatsu Ltd., Tokyo, Japan

[21] Appl. No.: 750,994

[22] PCT Filed: Jun. 26, 1995

[86] PCT No.: PCT/JP95/01274

§ 371 Date: Dec. 24, 1996

§ 102(e) Date: Dec. 24, 1996

[87] PCT Pub. No.: WO96/00351

PCT Pub. Date: Jan. 4, 1996

[30] Foreign Application Priority Data

Jun. 27, 1994 [JP] Japan ..... 6-144540

[51] Int. Cl.[6] ..... F15B 11/05

[52] U.S. Cl. ..... 137/596; 91/446; 137/596.13

[58] Field of Search ..... 91/446; 137/596, 137/596.13

[56] References Cited

U.S. PATENT DOCUMENTS

| | | | |
|---|---|---|---|
| 5,161,575 | 11/1992 | Morikawa et al. | 137/596.13 |
| 5,651,390 | 7/1997 | Ishihama et al. | 137/596 |

FOREIGN PATENT DOCUMENTS

| | | |
|---|---|---|
| 0582497 A1 | 2/1994 | European Pat. Off. . |
| 0608415 A1 | 8/1994 | European Pat. Off. . |
| 1-224505 | 9/1989 | Japan . |
| 2-51701 | 4/1990 | Japan . |
| 5-332306 | 12/1993 | Japan . |
| WO 93/21446 | 10/1993 | WIPO . |

*Primary Examiner*—Gerald A. Michalsky
*Attorney, Agent, or Firm*—Wenderoth, Lind & Ponack

[57] ABSTRACT

A directional control valve assembly having a pressure compensation valve in which there are provided a directional control valve in which a main spool is slidably inserted in a spool bore that is formed with a pump port, a first and a second load pressure detecting port, a first and a second actuator port, and a first and a second tank port; The pressure compensation valve that is connected with the pump port, includes: a pressure releasing zone which is adapted to the first and second load pressure detecting ports with the first and second tank ports when the spool lies its neutral position, and to block the first or second load pressure detecting port from the first or second tank port when the main spool lies at an intermediate site between the neutral position and a pressurized fluid supply position, and a passage having a counter flow preventing function for communicating the first or second actuator port and first and second load pressure detecting port with each other when the spool lies at an intermediate site between the neutral position and the pressurized fluid supply position.

8 Claims, 3 Drawing Sheets

DIRECTIONAL CONTROL VALVE ASSEMBLY HAVING A PRESSURE COMPENSATION VALVE

TECHNICAL FIELD

The present invention relates to a directional control valve assembly provided with a pressure compensation valve that can be used for feeding a pressurized discharge fluid from one or more hydraulic pumps to a plurality of actuators.

BACKGROUND ART

In a hydraulic circuit that is designed to feed a pressurized discharge fluid from one or more hydraulic pumps to a plurality of actuators using a plurality of directional control valves, it has been known that when a plurality of actuators are simultaneously fed with a pressurized discharge fluid, only an actuator of a low load pressure can be supplied with the pressurized discharge fluid and an actuator of a high load pressure cannot be supplied with any pressurized discharge fluid.

In an attempt to overcome this problem, there has been known a hydraulic circuit in which each directional control valve is provided with a pressure compensation valve and each of all the pressure compensation valves is set according to the highest load pressure to enable the actuators of different load pressures to be simultaneously supplied with a pressurized discharge fluid.

A directional control valve assembly that combines directional control valves with pressure compensation valves in this manner is disclosed in Japanese Unexamined Patent Publication No. Hei 05-332306.

Specifically, as shown in FIG. 1 of the accompanying hereof, the prior art directional control assembly disclosed in the above mentioned Patent Publication has a valve block 30 which is formed therein with a spool bore 31, a check valve bore 37 and a pressure reducing valve bore 38. The above mentioned valve block 30 is also formed therein with a pump port 44 that is open to the spool bore 31, with a first and a second load pressure detecting port 45 and 46, with a first and a second actuator port 34 and 35 and with a first and a second tank port 47 and 48. And, the spool bore 31 has a main spool 49 slidably inserted therein that is designed to establish and block communication between one of these ports and another, thus constituting a directional control valve 22.

The above mentioned valve block 30 is further formed therein with a first port 39 that is open to the check valve bore 37 and with a fluid path 56 for communicating the check valve bore 37 with the said pump port 44. And, the check valve bore 37 has a spool 60 slidably inserted therein that is designed to establish and block communication between the first port 39 and the fluid path 56 and that is stopped at its blocking position, thus constituting a check valve section 23.

The valve block 30 is further formed therein with a second and a third port 42 and 43 that are open to the pressure reducing valve bore 38. The pressure reducing valve bore 38 has a spool 64 slidably inserted therein that is provided with a rod 71 to form a first pressure chamber 65 and a second pressure chamber 66 so as to communicate the first pressure chamber 65 with the second load pressure detecting port 46 and to communicate the second pressure chamber 66 with the third port 43 via a small bore **64*a* that is provided in the spool 64. And, the above mentioned spool 64 is adapted to be energized by a spring 69 to displace in a given direction and to cause the rod 71 to penetrate through a bore 72 and to be brought into an abutting engagement with the spool 60 of the above mentioned check valve section 23 and to cause the spool 60 to be thrustedly held to its blocking position, thereby providing a pressure reducing valve section 24 and providing a pressure compensation valve 25 with the pressure reducing valve section 24 and the check valve section 23**.

An interstice formed between the thrusting rod 71 and the bore 72 mentioned above, is designed to be greater than an interstice formed between the spool 31 and the main spool 49 and an interstice formed between the pressure reducing valve bore 38 and the spool 64 and is designed to communicate with a reservoir 86.

And, the directional control assembly with a pressure compensation valve in the prior art is thus constructed as set out above.

With such a directional control assembly with a pressure compensation valve, it can be seen that by connecting a discharge path 21 of a hydraulic pump 20 to the above mentioned first and second ports 39 and 42, a load pressure detecting circuit 82 to the above mentioned third port port 43 and an actuator 88 to the above mentioned first and second actuator ports 34 and 35, the pressure compensating valve 25 will be set at a differential pressure between the highest load pressure acting on the load pressure detecting circuit 82 and the pump pressure so that the pressurized discharge fluid from the hydraulic pressure 20 my be supplied simultaneously to a plurality of actuators 88.

And, when the retention pressure of an actuator 88 acts on the first pressure chamber 65 of the pressure reducing valve section 24 from the interstice formed between the spool bore 31 and the main spool 49, it can be seen that owing to the fact that a fluid under the pressure will be discharged into the reservoir 86 from the interstice formed between the thrusting rod 71 and the bore 72. There will develop no situation in which the discharge pressure of the hydraulic pump 20 may be increased due to leakages of the fluid at various parts of the system when the main spool 49 of the directional control valve 22 lies at its neutral position while the hydraulic motor 20 is being driven.

This action can more specifically be explained as set forth below.

Thus, the retention pressure of the actuator 88 will act on the second actuator port 35 and, since a fluid thereunder is leaked through the interstice formed between the spool bore 31 and the main spool 49 in the valve block 30, will act on the first pressure chamber 65 of the pressure reduction valve section.

Also, the discharge pressure of the hydraulic pump 20 will act on the first pressure chamber 65 through the interstice between the spool 64 and the bore 38 in the pressure reducing valve section and through the interstice formed between the spool bore 31 and the main spool 49.

With the retention pressure and the discharge pressure acting on the first pressure chamber 65 in the pressure reducing section 24 due to fluid leakages at various parts of the system in this manner, the spool 64 will slidably be displaced rightwards to communicate the second port 42 with the third port 43 and to cause a fluid under the pressure (i.e. the hydraulic pump discharge pressure) in the second port 42 to be supplied into the second pressure chamber 66, thus causing the pressure in the second pressure chamber 66 to act to thrust the spool 64 leftwards and in turn the pressure and the pressure in the first pressure chamber 65 to be balanced. Then, a fluid under pressure in the second pressure chamber 66 will be led to act on a swash angle control valve 85 via the load pressure detecting circuit. This will result in an increase in the control pressure acting on the swash angle control valve 85 so as to increase the rate of discharge and the discharge pressure of the hydraulic pump 20.

Under the circumstances, if the interstice formed between the thrusting rod 71 provided in the spool 64 in the pressure reducing valve section 24 and the bore 72 in the valve block 30 is designed, as mentioned previously, to be greater than the interstice formed between the spool bore 31 and the main spool 49 in the valve block 30 and than the interstice formed between the pressure reducing valve bore 38 and the spool 64 to allow the first mentioned interstice to communicate with the reservoir 86, it can be seen that when the retention pressure of the actuator 88 and the discharge pressure of the said hydraulic pump 20 act on the said first pressure chamber 65 through the various interstices of the system, a fluid under the pressures will be caused to flow into the reservoir 86 via the interstice formed between the thrusting rod 71 and the said bore 72. Since the spool 64 in the pressure reducing valve section 24 will then no longer be moved slidably rightwards, it follows that there will be no increase in the discharge pressure of the hydraulic pump 20.

With such a directional control valve assembly that is provided with a pressure compensation valve, however, if an area of opening between the pump port 44 and the first, second load pressure detecting port 45, 46 and an area of opening between the first, second load pressure detecting port 45, 46 and the first, second actuator port 34, 35 are each small, it has been found that since a portion of the pump pressurized discharge fluid flowing into the pump port 44 is allowed to flow out of the interstice formed between thrusting rod 71 and the bore 72 into the reservoir 86, the pressure in the load pressure detecting port will be lower than the pressure in the actuator port. As a result, an operating machine and so forth as actuated by an actuator will spontaneously be lowered by gravity under an external load.

Accordingly, the present invention is provided in view of the problems mentioned above and has its object to provide a directional control valve assembly provided with a pressure compensation valve in which when a main spool in a directional control valve lies at its neutral position while a hydraulic valve is being driven there will be no increase in a discharge pressure in the hydraulic pump due to fluid leakages at various parts of the system in such an assembly. Also, if an area of opening between a pump port and a load pressure detecting port and an area of opening between the load pressure detecting port and an actuator port are each small, there will be no situation in which an operating machine and so forth as actuated under an external load by an actuator may be lowered spontaneously by gravity.

SUMMARY OF THE INVENTION

In order to achieve the object mentioned above, there is provided in accordance with the present invention, in one form of the embodiments thereof, a directional control valve assembly having a pressure compensation valve in which there are provided

- a directional control valve in which a main spool is slidably inserted in a spool bore formed with a pump port, a first and second load pressure detecting port, a first and a second actuator port and a first and a second tank port and is adapted to establish and block communication between one of the ports and another; and
- the pressure compensation valve that is connected with the pump port, characterized in that it comprises:
  - a pressure releasing zone which is adapted to communicate the first and second load pressure detecting ports with the first and second tank ports when the main spool lies at a neutral position and which is adapted to block the first or second load pressure detecting port from the first or second tank port; and
  - a passage having a counter flow preventing function for communicating between the first or second actuator port and the first or second load pressure detecting port when the spool lies at an intermediate site between the neutral position and a pressurized fluid supply position.

In addition to the construction mentioned above, it is desirable that after the passage is communicated the pressure releasing zone should be blocked, whereafter the pump port should be allowed to communicate with the second or first load pressure detecting port, and the first or second load pressure detecting port should subsequently be allowed to communicate directly with the said first or second actuator port.

More specifically in the construction mentioned above, it is preferred that a relationship should be satisfied that $L1<S1<L3<L2$ where S1 represents a distance that the main spool moves from the neutral position until the pressure releasing zone is blocked from the said first tank port; L1 represents a distance that the main spool moves from the neutral position until the passage is allowed to communicate with the first or second actuator port; L2 represents a distance that the main spool moves from the neutral position until the first or second load pressure detecting port and the first or second actuator port communicate with each other; and L3 represents a distance that the main spool moves from the said neutral position until the second or first load pressure detecting port and the pump port communicate with each other.

According to the constructions mentioned above, it can be seen that when the main spool lies at its neutral position while the hydraulic pump is being driven, the first and second load pressure detecting ports will be allowed to communicate with the first and second tank ports via the pressure releasing zone and a pressurized fluid that is introduced through various interstice will be allowed to flow out into the first and second tank ports so that no pressure may build up in the first pressure chamber of the said pressure reducing valve section. Hence there will develop no increase in the discharge pressure in the hydraulic pump.

It can also be seen that when the spool is somewhat displaced slidably from the neutral position towards the pressurized fluid supply position, the first or second load pressure detecting port will be allowed to communicate with the first or second actuator port via the passage; when the spool is further slidably displaced, the pressure releasing zone will be blocked; when the main spool is still further displaced slidably, the pump port will be allowed to communicate with the second or first load pressure detecting port; when the main spool is yet further displaced the first or second load pressure detecting port will be allowed to communicate with the first or second actuator port. In the meantime, by virtue of the fact that the passage from an actuator port to a load pressure detecting port is provided with a counter flow preventing function, an operating member or machine for actuation by an actuator will no longer be spontaneously lowered by gravity under any external load.

According to a further specific feature of the present invention, there is preferably provided a directional control valve assembly having a pressure compensation valve, in which:

a valve block is formed therein with a spool bore, a check valve bore, a pressure reducing valve bore and a penetration bore;

the valve block is also formed therein with a pump port that is open to the spool bore, a first and a second load pressure detecting port, a first and a second actuator port, and a first and a second tank port, the spool bore having a main spool slidably inserted therein for establishing and blocking a communication between one of the ports and another;

the valve block is further formed therein with a first port that is open to the check valve bore and a fluid path that is adapted to communicate the check valve bore with the pump port, the check valve bore having a spool slidably inserted therein that is adapted to establish and block communication between the first port and the fluid passage and that is adapted to be stopped at a blocking position thereof, constituting a check valve section therein;

the valve block is still further formed therein with a second and a third port, the pressure reducing valve bore having a spool slidably inserted therein that is provided with a rod to form a first pressure chamber and a second pressure chamber therein so as to allow the second pressure chamber to communicate with the third port, the spool being adapted to be energized by a spring to displace in a given direction and then to cause the rod to penetrate a penetration bore and the check valve section to be brought into an abutting engagement with the spool, thereby permitting the spool to be thrustedly held to a blocking position thereof and providing a pressure reducing valve section;

a pressure compensation valve is constituted with the pressure reducing valve section and the check valve section; and a pressure releasing zone and a passage are formed interiorly of the main spool.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Figure 1:
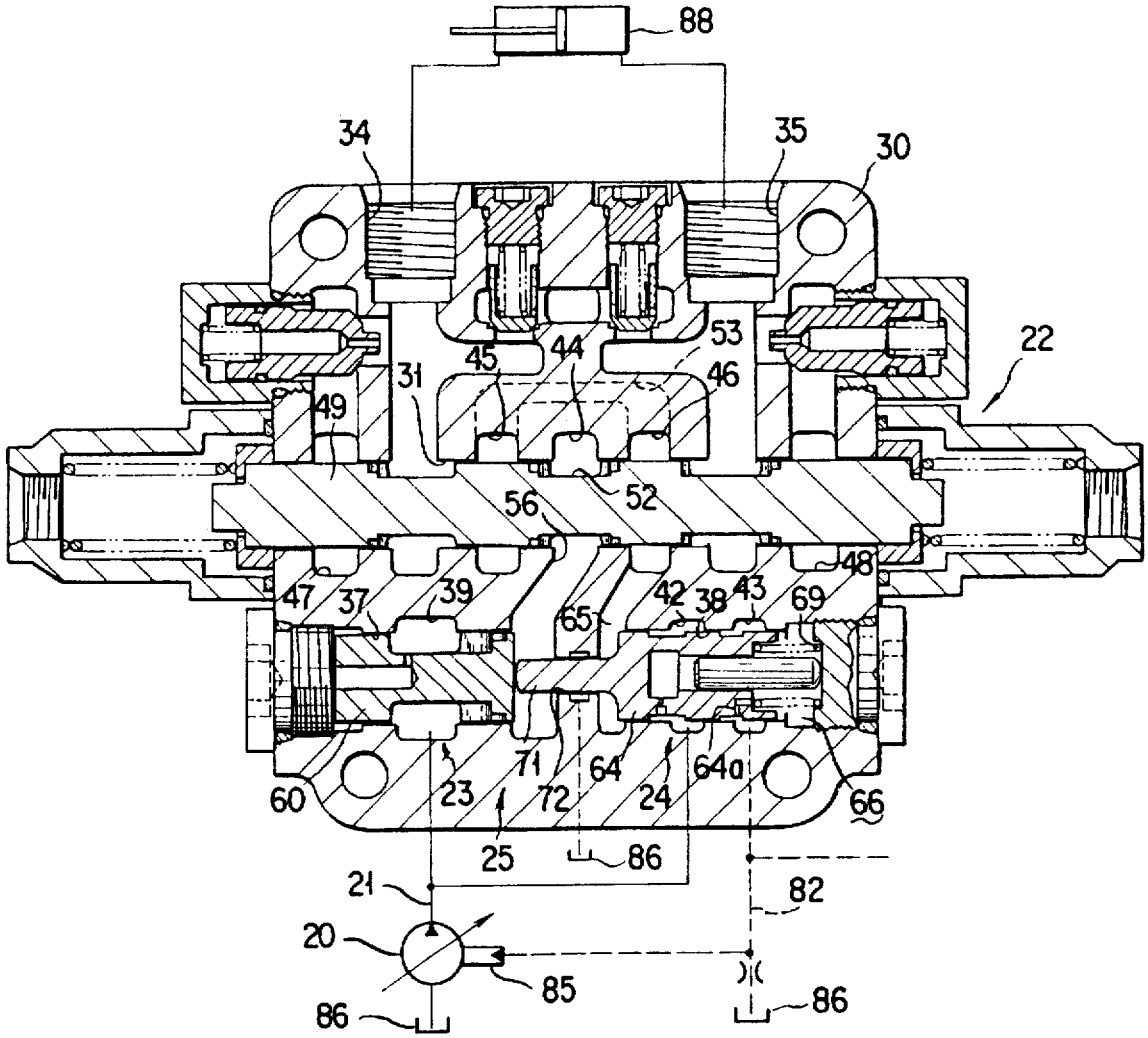
FIG. 1 (PRIOR ART)
FIG. 1 is a cross sectional view illustrating a directional control valve which is known provided with a pressure compensation valve in the prior art.

Hereinafter, suitable embodiments of the present invention with respect to a slide control method will be set forth with reference to the accompanying drawings hereof, explanation will now be provided with respect to a certain embodiment of the present invention with reference to FIG. 2 of the accompanying drawings hereof. In this connection, it should be noted that in the explanation of such an embodiment, same reference numerals as used in the description of the prior art are used to designate the same components.

A valve block 30 has a substantially rectangular configuration. The valve block 30 is formed in an upper part thereof with a spool bore 31 that is open to both its left hand side and right hand side surfaces 32 and 33. The valve block 30 is formed in a lower part thereof with a check valve bore 37 that is open at its one end to the left hand side surface thereof 32 and a pressure reducing valve bore 38 that is open at its one end to the right hand side surface thereof 33. The bores 37 and 38 are formed coaxially with and in opposition to each other. Open to the above mentioned check valve bore 37 there is also formed a first port 39 that is open to its front and rear surfaces. Open to the above mentioned pressure reducing valve bore 38, there are further formed a second and a third port 42 and 43 which are each open to its front and rear surfaces. If a plurality of such valve blocks 30 are connected to one another with one's rear surface confronted with another's front surface, the respective ports 39, 42 and 43 of these blocks 30 are constructed so that each will communicate with one block to another.

The above mentioned valve block 30 is also formed therein with a pump port 44, a first and a second load pressure detecting port 45 and 46, a first and a second actuator port 34 and 35 and a first and a second tank port 47 and 48, each of these ports being open to the spool bore 31. The respective other ends of the first and second actuator ports 34 and 35 are each open to an upper surface 36. A main spool 49 is slidably inserted in the spool bore 31 and is formed with a first and a second small diameter portion 50 and 51 and an intermediate small diameter portion 52. The valve block 30 is further formed with a first fluid path 53 that is designed to communicate the said first and second load pressure detecting ports 45 and 46 with each other at all times. It will also be seen that the main spool 49 is held at a neutral position thereof with a pair of springs for blocking communication of one of the ports from another. And, if the spool 49 is slidably displaced rightwards under a pilot pressure or the like, the second actuator port 35 will be allowed to communicate at the second small diameter portion 51 with the second tank port 48, the pump port 44 will be allowed to communicate at the intermediate small diameter portion 52 with the seemed load pressure detecting port 46 and the first actuator port 34 will be allowed to communicate at the first small diameter portion 50 with the first load pressure detecting port 45 and thus to bring about a first pressurized fluid supply position at which communication between the actuator port 34 and the tank port 47 will be blocked. And, if the main spool 49 is slidably displaced leftwards, the first actuator port 34 will be allowed to communicate at the first small diameter portion 50 with the first tank port 47, the pump port 44 will be allowed to communicate at the intermediate small diameter portion 52 with the first load pressure detecting port 45 and the second actuator port 35 will be allowed to communicate at the second small diameter portion 51 with the second load pressure detecting port 46 and thus to bring about a second pressurized fluid supply position at which communication between the second actuator port 35 and the second tank port 48 will be blocked. Thus, in this fashion, a directional control valve 22 is constructed.

In the valve block 30, the above mentioned check valve bore 37 is designed to communicate through a fluid path 56 with the pump port 44 and to have a valve 60 or spool slidably inserted therein for establishing and blocking a communication between the first port 39 and the pump port 44. The valve or spool 60 is restricted with a plug 61 5D as not to be slidably displaced leftwards but to be held at its blocking position. The spool 60 is formed with a small diameter portion 104 for establishing and blocking communication between the first port 39 and the pump port 44. The check valve 37 is designed to define, separately from the first port 39, a pressure chamber 105 that is adapted to thrust the spool 60 rightwards. The pressure chamber 105 communicates with the first port 39 through a damper throttle 106 and a communicating bore 107 which are formed in the spool 60. With such a construction as mentioned above, it will be seen that since a pressurized fluid is caused to flow through the damper throttle 106 between the first port 39 and the pressure chamber 105 when the spool 60 is slidably displaced rightwards or leftwards, the spool 60 can be prevented from abruptly being slidably displaced leftwards or rightwards slidably. Thus, a check valve section 23 is so constructed.

In the valve block 30, the above mentioned pressure reducing valve bore 38 is designed to communicate with the second load pressure detecting port 46 through a fourth port 57 and a fluid path 58. The pressure reducing valve bore 38 has a spool 64 slidably inserted therein to form a first pressure chamber 65 and a second pressure chamber 66. The first pressure chamber 65 is designed to communicate with the fourth port 57 whereas the second pressure chamber 66 is designed to communicate with the third port 43. It can be seen that a free piston 68 is inserted in a blind hole 67 in the above mentioned spool 64 and that a spring 69 is provided between the spool 64 and the plug 70. In a state in which the spool 64 is energized with the spring 69 to displace leftwards and then to project a thrusting rod 71 made integral with the spool 64 through a penetration bore 72, the above mentioned valve or spool 60 will be brought into abutting engagement with the plug 61 under a pressure.

It can also be seen that the spool 64 is formed with a slit-like aperture 100 that is designed to establish and block a communication between the third port 43 and the second port 42. Thus, when the spool 64 is displaced rightwards, a pressurized fluid in the second port 42 will be directly supplied into the load pressure detecting port 82 through the aperture 100 and the third port 43. It should be noted that the second pressure chamber 66 is designed to communicate with the third port 43 via a damper throttle 101 and that the pressure chamber 102 of the free piston 68 is designed to communicate with the aperture 100 through a damper throttle 101. With such a construction as mentioned above, it can be seen that when the spool 64 is slidably displaced rightwards, a pressurized fluid in the second pressure chamber 66 will be caused to flow into the third port 43 through the damper throttle 101 whereas a pressurized fluid in the pressure chamber 102 will be caused to flow into the second port 42 through the damper throttle 101, thus preventing the spool 64 from being abruptly slidably displaced rightwards. When the spool 64 is slidably displaced leftwards, it can be seen that each of these pressurized fluids will be caused to flow in a sense opposite to the above, thus preventing the spool 64 from being abruptly slidably displaced leftwards.

And, it will be apparent that the foregoing construction constitutes a pressure reducing valve section 24 and that a pressure compensation valve 25 is constituted with this pressure reducing valve section 24 and the above mentioned check valve section 23.

It will further be seen that the discharge path 21 of a hydraulic pump 20 is designed to communicate with the first port 39 and the second port 42, and that the first and second actuator ports 34 and 35 are designed to communicate with an actuator 88 through a first and a second pipe conduit 89 and 90, respectively. Further, a load pressure detecting path 82 is connected to a swash plate angle control valve 58 to act to control the capacity of the hydraulic pump 20 by rotationally inclining a swash plate 83 so that a differential pressure between the pump discharge pressure and a load pressure may reach a predetermined value under the action of the swash plate angle control valve 85.

In this connection, it should be noted that the load pressure detecting path 82 is designed to communicate with a reservoir 86 via a throttle 91.

Figure 3:
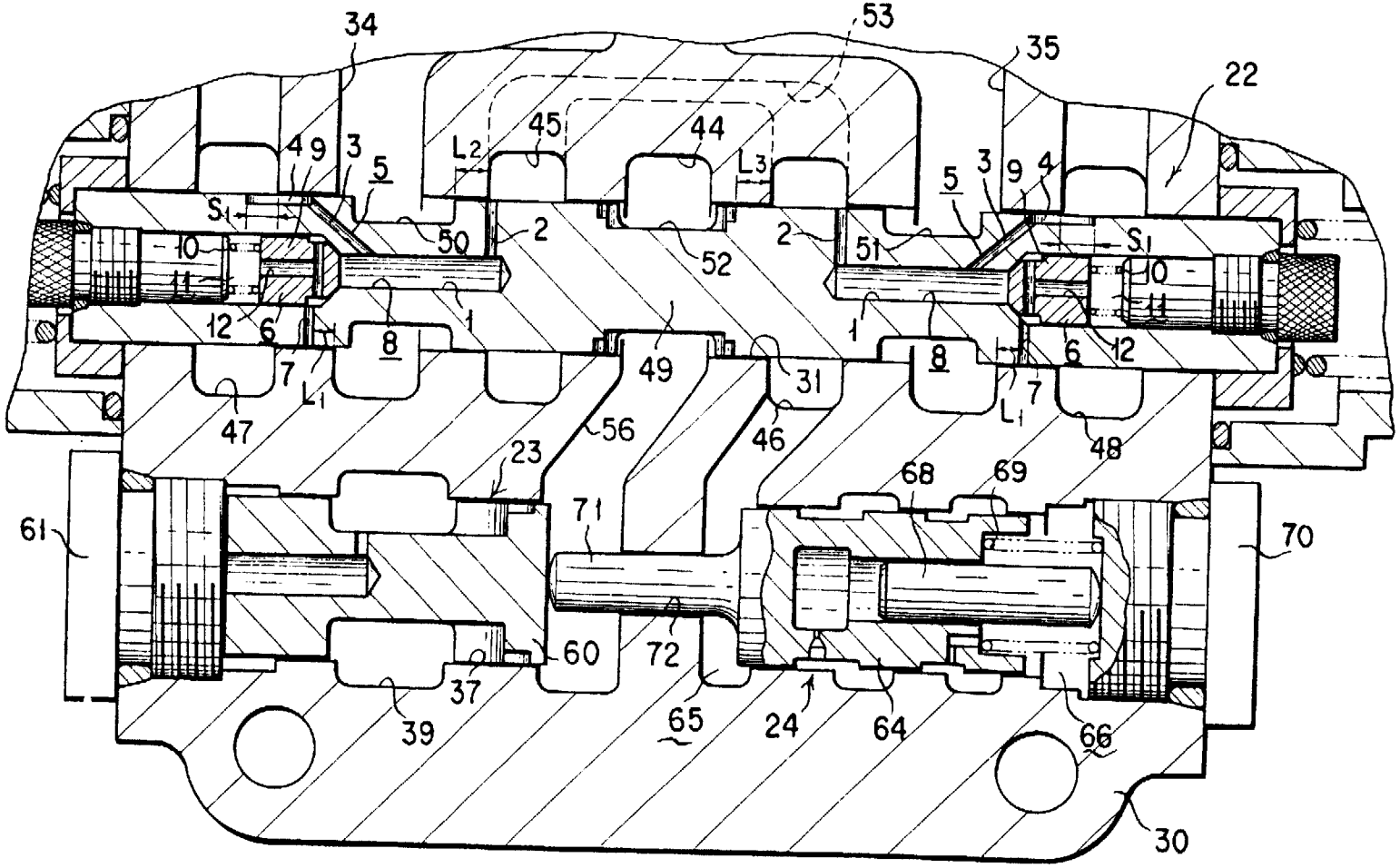
FIG. 3 is an enlarged cross sectional view illustrating an essential portion the above mentioned embodiment of the present invention.

The above mentioned main spool 49 is formed at its left side interior portion in its longitudinal direction with a fluid bore 1 that extends in its axial direction as shown in FIG. 3. This fluid bore 1 is designed to be open to the side of the first load pressure detecting port 45 through a first bore 2 formed in a radial direction thereof while opening to the side of the first tank port 47 through a second bore 3 that extends in an oblique direction and a slit 4, thereby providing a pressure releasing zone 5 with the bore 3 and the slit 4.

In the check valve 6, a valve 9 is adapted to be energized with a spring 10 to bring itself to its closing position and to communicate a spring chamber 11 with the third bore 7 through a bore 12 and that there is applied a function for preventing a counter flow from the third bore to the said first bore 2 and the pressure releasing zone 5.

An explanation in some more detail will now be given with respect to the operation of the above mentioned directional control valve assembly as well as the function of pressure releasing zone 5 and the passage 8, reference being had to FIG. 3 of the accompanying drawings hereof.

When the main spool 49 lies at its neutral position, it can be seen that the first bore 2 will be open to the first load pressure detecting port 45, the second bore 3 will be open to the first tank port 47 through the slit 4 and the third bore 7 will be closed.

As a result, a pump discharge fluid which is introduced into a path 56 through an interstice formed between the check valve bore 37 of the check valve section 23 and the spool 60 will be caused to flow into the first load pressure detecting port 45 through the pump port 44 and through an interstice formed between the spool 31 and the main spool 49 and to flow out into the first tank port 47 through the first bore 2, the fluid bore 1, the second bore 3 and the slit 4 (i.e. the pressure releasing zone 5). Since no pressure then develops in the first load pressure detecting port 45, there will be no pressure developed in the first pressure chamber 65.

Also, whilst the pump discharge fluid that is introduced into the above mentioned path 56 is caused to flow into the first pressure chamber 65 through an interstice formed between the thrusting rod 71 and the penetration bore 72, the pump discharge fluid that has been introduced into the first pressure chamber 65 will be caused to flow into the first load pressure detecting port 45 through the second load pressure detecting port 46 and a path 53 and to flow out into the first tank port 47 through the pressure releasing zone 5 in such a like manner as mentioned above. Hence there will be no pressure developed in the first chamber 65.

Also, a fluid under the retention pressure of an actuator that is developed in the second actuator port 35 will flow into the second load pressure detecting port 46 and will flow into the tank port 47 out of the pressure releasing zone 5 in such a like manner as mentioned above.

As a consequence, the pressurized fluid that is introduced into the first load pressure detecting port 45 or the second load pressure detecting port 46 through interstices at various portions of the system when the main spool 49 lies at its neutral position will flow into the first tank port and, since no pressure then develops in the first pressure chamber 65 of the pressure reducing valve section 24, there will be no increase in the discharge pressure of the hydraulic pump 20.

By the way, if it is assumed that the distance that the main spool 49 moves from its neutral position until the slit 4 is blocked from the first tank port 47 is represented by S1, the distance that the main spool 49 moves from the neutral position until the third bore 7 comes to communicate with the first actuator port 34 is represented by L1, the distance that the main spool 49 moves from the neutral position until the first load pressure detecting port 45 and the first actuator port 34 come to communicate with each other is represented by L2, and the distance that the main spool 49 moves from the neutral position until the second load pressure detecting port 46 and the pump port 44 come to communicate with each other is represented by L3, there is applied here a relationship: $L1<S1<L3<L2$.

This being the case, it can be appreciated that when the main spool 49 is displaced from its neutral position rightwards, firstly a communication will occur between the third bore 7 and the actuator port 34 to communicate the first load pressure detecting port with the first actuator port 34 via the said passage 8, thereafter the slit 4 will be closed to block the first load pressure detecting port 45 from the said tank port 47, subsequently the pump port 44 will communicate with the second load pressure detecting port 46 and finally the first load pressure detecting port 45 will communicate with the first actuator port 34.

Accordingly, it can be apparent that before the first load pressure detecting port 45 and the first actuator port 34 communicate directly with each other, the first load pressure detecting port 45 and the first actuator port 34 will communicate with each other via the third bore 7 of the passage 8. In addition, the pressure releasing zone 5 will be blocked by the time when the main spool 49 is displaced to the pressurized fluid supply position to communicate the first load pressure detecting port 45 and the first actuator port 34 directly each other. And yet, since the passage 8 does not allow a pressurized fluid to flow from the third bore 7 into the fluid bore 1 with the check valve 6, there will be no counter flow of the pressurized fluid in the said first actuator port 34 into the said first load pressure detecting port 45. It follows, therefore, that since the pressurized fluid that is introduced into the actuator port 44 even if the area of opening at the communication portion is small is not allowed to flow into the first tank port 47 but into the first actuator port 34, there will no longer be a case in which an actuator is reversely operated under an external load to permit an operating member or machine to be spontaneously lowered by gravity.

Figure 2:
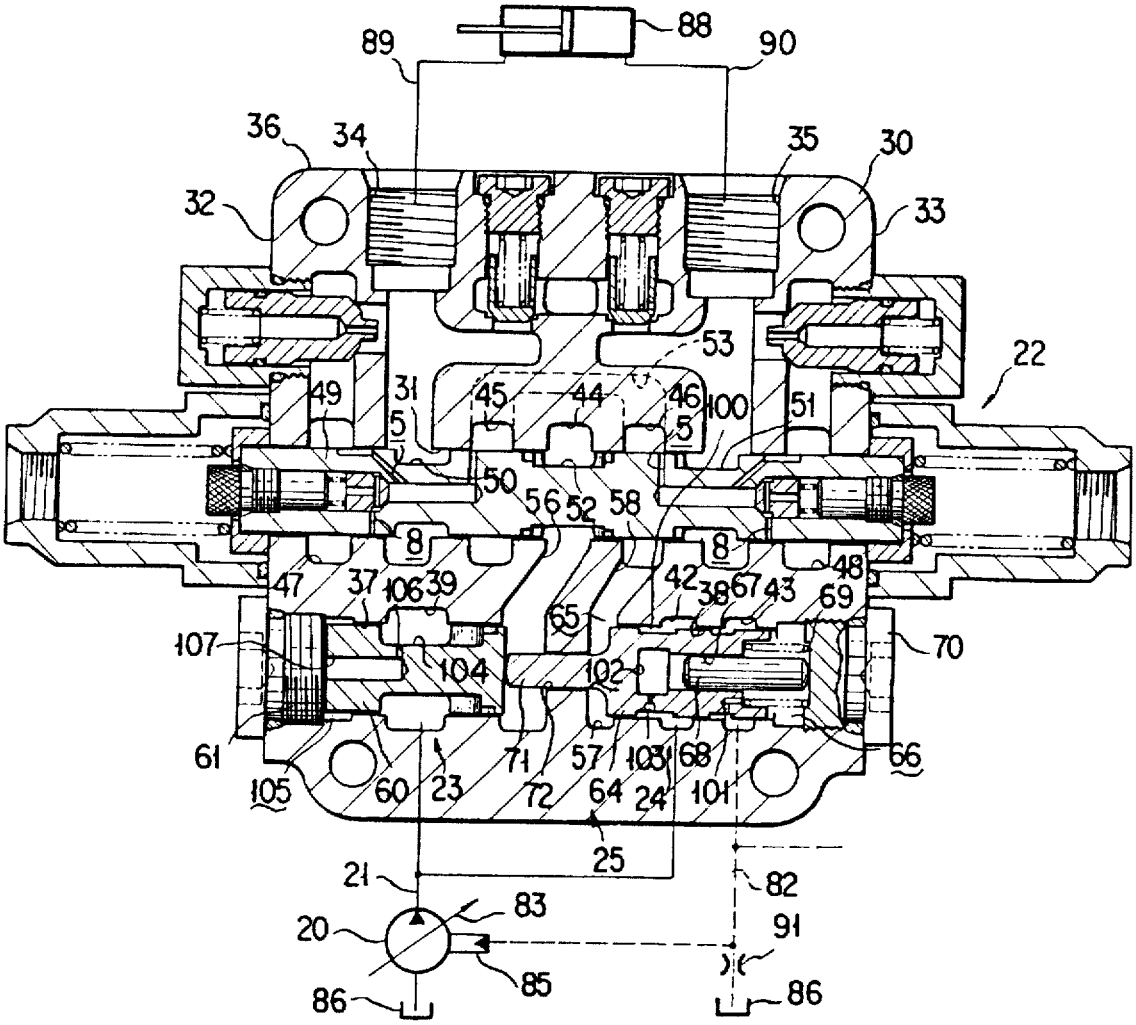
FIG. 2 is a cross sectional view illustrating a certain embodiment of a directional control valve provided with a pressure compensation valve according to the present invention.

It should be noted at this point that as shown in FIG. 2 a pressure releasing zone or passage 5 and a passage 8 are also provided at a right side interior portion of the main spool 49 in its longitudinal direction. Thus, an operation as mentioned above is likewise carried out when the main spool 49 is slidably displaced leftwards from its neutral position.

As described in the foregoing, according to the present invention in which when the main spool 49 lies at its neutral position the first and a second load pressure detecting port 45 and 46 are allowed to communicate with the first and second tank ports 47 and 48 through the pressure releasing zone 5 so that a pressurized fluid that is introduced through interstices at various portions of the system may flow out into the first and second tank ports 47 and 48, there will develop no pressure in the first pressure receiving part 65 of the pressure reducing section 24 and hence there will be no increase in the discharge pressure of the hydraulic pump 20.

Also, when the main spool 49 is slidably displaced from its neutral position somewhat leftwards or rightwards towards a communicating position, the first and second load pressure detecting portions 45 and 46 are allowed to communicate with the first or second actuator port 34 or 35 through the passage 8 at the left hand side or the passage 8 at the right hand side. When the main spool 49 is further slidably displaced, the pressure releasing zone 5 at the left hand side or the right hand side will be closed to block the first or second tank ports 47 or 48 until the first first and second load pressure detecting ports 45 and 46 are allowed to directly communicate with the first or second actuator port 34 or 35 through the main spool 49. And yet, since a passage 8 is provided with a counter flow preventing function, there will be no reverse flow from the passage 8 of the first, or second actuator ports 34, 35. Thus, there will no longer be a case in which an actuator is reversely operated under an external load to permit an operating member or machine to be spontaneously lowered by gravity.

While the present invention has hereinbefore been described with respect to a certain illustrative embodiment thereof, it will readily be appreciated by a person skilled the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A directional control valve assembly comprising:

a valve block defining a spool bore, a first load pressure detecting port, a second load pressure detecting port, a first actuator port, a second actuator port, a first tank port, and a second tank port;

a pump port formed in an inner peripheral surface of said spool bore, pump port being connected to a hydraulic pump;

a main spool slidably inserted in said spool bore;

a first pressure release passage formed in said main spool and located so as to establish fluid communication between said first load pressure detecting port and said first tank port when said main spool is in a neutral position, wherein said fluid communication between said first load pressure detecting port and said first tank port is blocked when main said spool is displaced from said neutral position to a first pressurized fluid supply position to prevent an increase in discharge pressure from said hydraulic pump;

a second pressure release passage formed in said main spool and located so as to establish fluid communication between second load pressure detecting port and said second tank port, wherein said fluid communication between said second load pressure detecting port and said second tank port is blocked when said main spool is displaced from said neutral position to a second pressurized fluid supply position to prevent an increase in discharge pressure from said hydraulic pump;

a first flow passage formed in said main spool and located so as to establish fluid communication between said first actuator port and first load pressure detecting port when said main spool is at an intermediate position between said neutral position and said first pressurized fluid supply position;

a first check valve disposed in said first flow passage to prevent reverse flow through said first flow passage;

a second flow passage formed in said main spool and located so as to establish fluid communication between said second actuator port and said second load pressure detecting port when said main spool is at an intermediate position between said neutral position and said second pressurized fluid supply position; and a second check valve disposed in said second flow passage to prevent reverse flow through said second flow passage.

2. The directional control valve assembly as claimed in claim 1, further comprising:

a first reduced diameter portion formed in said main spool; and a second reduced diameter portion formed in said main spool;

wherein after said first and second flow passages establish fluid communication between said first and second actuator ports and said first and second load pressure detecting ports, respectively, and first and second pressure release passages are blocked, respectively, then said pump port communicates with one of said first or second load pressure detecting ports, and said first and second load detecting ports communicates directly with said first and second actuator ports via said first and second reduced diameter portions, respectively.

3. The directional control valve assembly as claimed in claim 2, wherein valve assembly satisfies the condition that $L1<S1<L3<L2$, where:

S1 represents a distance that said main spool moves from said neutral position until one of said first and second pressure release passages is blocked from said first tank port;

L1 represents a distance that said main spool moves from said neutral position until said first flow passage communicates with said first actuator port or said second flow passage communicates with said second actuator port;

L2 represents a distance that said main spool moves from said neutral position until said first load pressure detecting port communicates with said first actuator port or said second load pressure detecting port communicates with said second actuator port; and L3 represents a distance that said main spool moves from said neutral position until said first or second load pressure detecting port communicates with said pump port.

4. The directional control valve assembly as claimed in claim 3, further comprising:

a check valve bore formed in said valve block;

a pressure reducing valve bore formed in said valve block;

a penetration bore formed in said valve block and extending between said check valve bore and said pressure reducing valve bore;

a fluid path formed in said valve block and extending between said check valve bore and said pump port;

a first port formed in an inner peripheral surface of said check valve bore;

a spool slidably disposed in said check valve bore for establishing and blocking communication between said first check valve port and said fluid path;

second port formed in an inner peripheral surface of said pressure reducing valve bore;

a third port formed in an inner peripheral surface of said pressure reducing valve bore;

a spool slidably disposed in said pressure reducing valve bore and including a rod, wherein said spool and said pressure reducing valve bore define a first pressure chamber and a second pressure chamber in communication with said third port; and a spring for biasing said pressure reducing valve bore spool in a given direction so as to cause said rod to extend into said penetration bore and engage an end surface of said check valve bore spool, wherein said valve spool, disposed in said check valve bore, is biased into a blocking position.

5. A directional control valve assembly comprising:

a valve block defining a spool bore, a first load pressure detecting port, a second load pressure detecting port, a first actuator port, a second actuator port, a first tank port, and a second tank port;

a pump port formed in an inner peripheral surface of said spool bore;

a main spool slidably inserted in said spool bore;

a first reduced diameter portion formed in said main spool;

a second reduced diameter portion formed in said main spool;

a first pressure release passage formed in said main spool and located so as to establish fluid communication between said first load pressure detecting port and said first tank port when said main spool is in a neutral position, wherein said fluid communication between said first load pressure detecting port and said first tank port is blocked when said main spool is displaced from said neutral position to a first pressurized fluid supply position;

a second pressure release passage formed in said main spool and located so as to establish fluid communication between said second load pressure detecting port and said second tank port, wherein said fluid communication between said second load pressure detecting port and said second tank port is blocked when said main spool is displaced from said neutral position to a second pressurized fluid supply position;

a first flow passage formed in said main spool and located so as to establish fluid communication between said first actuator port and said first load pressure detecting port when said main spool is at an intermediate position between said neutral position and said first pressurized fluid supply position;

a first check valve disposed in said first flow passage;

a second flow passage formed in said main spool and located so as to establish fluid communication between said second actuator port and said second load pressure detecting port when said main spool is at an intermediate position between said neutral position and said second pressurized fluid supply position; and a second check valve disposed in said second flow passage, wherein after said first and second flow passages establish fluid communication between said first and second actuator ports and said first and second load pressure detecting ports, respectively, and said first and second pressure release passages are blocked, respectively, then said pump port communicates with one of said first or second load pressure detecting ports, and said first and second load detecting ports communicates directly with said first and second actuator ports via said first and second reduced diameter portions, wherein said valve assembly satisfies the condition that $L1<S1<L3<L2$, where:

S1 represents a distance that said main spool moves from said neutral position until one of said first and second pressure release passages is blocked from said first tank port;

L1 represents a distance that said main spool moves from said neutral position until said first flow passage communicates with said first actuator port or said second flow passage communicates with said second actuator port;

L2 represents a distance that said main spool moves from said neutral position until said first load pressure detecting port communicates with said first actuator port or said second load pressure detecting port communicates with said second actuator port; and L3 represents a distance that said main spool moves from said neutral position until said first or second load pressure detecting port communicates with said pump port.

6. The directional control valve assembly as claimed in claim 5, further comprising:

a check valve bore formed in said valve block;

a pressure reducing valve bore formed in said valve block;

a penetration bore formed in said valve block and extending between said check valve bore and said pressure reducing valve bore;

a fluid path formed in said valve block and extending between said check valve bore and said pump port;

a first port formed in an inner peripheral surface of said check valve bore;

a spool slidably disposed in said check valve bore for establishing and blocking communication between said first check valve port and said fluid path;

a second port formed in an inner peripheral surface of said pressure reducing valve bore;

a third port formed in an inner peripheral surface of said pressure reducing valve bore;

a spool slidably disposed in said pressure reducing valve bore and including a rod, wherein said spool and pressure reducing valve bore define a first pressure chamber and a second pressure chamber in communication with said third port;

a spring for biasing said pressure reducing valve bore spool in a given direction so as to cause said rod to extend into said penetration bore and engage an end surface of said check valve bore spool, wherein said valve spool, disposed in said check valve bore, is biased into a blocking position.

7. A directional control valve assembly comprising:

a valve block defining a spool bore, a first load pressure detecting port, a second load pressure detecting port, a first actuator port, a second actuator port, a first tank port, and a second tank port;

a pump port formed in an inner peripheral surface of said spool bore;

a main spool slidably inserted in said spool bore;

a first reduced diameter portion formed in said main spool;

a second reduced diameter portion formed in said main spool;

a first pressure release passage formed in said main spool and located so as to establish fluid communication between said first load pressure detecting port and said first tank port when said main spool is in a neutral position, wherein said fluid communication between said first load pressure detecting port and said first tank port is blocked when said main spool is displaced from said neutral position to a first pressurized fluid supply position;

a second pressure release passage formed in said main spool and located so as to establish fluid communication between said second load pressure detecting port and said second tank port, wherein said fluid communication between said second load pressure detecting port and said second tank port is blocked when said main spool is displaced from said neutral position to a second pressurized fluid supply position;

a first flow passage formed in said main spool and located so as to establish fluid communication between said first actuator port and said first load pressure detecting port when said main spool is at an intermediate position between said neutral position and said first pressurized fluid supply position;

a first check valve disposed in said first flow passage;

a second flow passage formed in said main spool and located so as to establish fluid communication between said second actuator port and said second load pressure detecting port when said main spool is at an intermediate position between said neutral position and said second pressurized fluid supply position;

a second check valve disposed in said second flow passage, wherein after said first and second flow passages establish fluid communication between said first and second actuator ports and said first and second load pressure detecting ports, respectively, and said first and second pressure release passages are blocked, respectively, then said pump port communicates with one of said first or second load pressure detecting ports, and said first and second load detecting ports communicates directly with said first and second actuator ports via said first and second reduced diameter portions;

a check valve bore formed in said valve block;

a pressure reducing valve bore formed in said valve block;

a penetration bore formed in said valve block and extending between check valve bore and said pressure reducing valve bore;

a fluid path formed in said valve block and extending between said check valve bore and said pump port;

a first port formed in an inner peripheral surface of said check valve bore;

a spool slidably disposed in said check valve bore for establishing and blocking communication between said first check valve port and said fluid path;

a second port formed in an inner peripheral surface of said pressure reducing valve bore;

a third port formed in an inner peripheral surface of said pressure reducing valve bore;

a spool slidably disposed in said pressure reducing valve bore and including a rod, wherein spool and said pressure reducing valve bore defining a first pressure chamber and a second pressure chamber in communication with said third port; and a spring for biasing said pressure reducing valve bore spool is a given direction so as to cause said rod to extend into penetration bore and engage an end surface of said check valve bore spool, wherein said valve spool disposed in said check valve bore is biased into a blocking position.

8. A directional control valve assembly comprising:

a valve block defining a spool bore, a first load pressure detecting port, a second load pressure detecting port, a first actuator port, a second actuator port, a first tank port, and a second tank port;

a pump port formed in an inner peripheral surface of said spool bore;

a main spool slidably inserted in said spool bore;

a first pressure release passage formed in said main spool and located so as to establish fluid communication between said first load pressure detecting port and said first tank port when said main spool is in a neutral position, wherein said fluid communication between said first load pressure detecting port and said first tank port is blocked when said main spool is displaced from said neutral position to a first pressurized fluid supply position;

a second pressure release passage formed in said main spool and located so as to establish fluid communication between said second load pressure detecting port and said second tank port, wherein said fluid communication between said second load pressure detecting port and said second tank port is blocked when said main spool is displaced from said neutral position to a second pressurized fluid supply position;

a first flow passage formed in said main spool and located so as to establish fluid communication between said first actuator port and said first load pressure detecting port when said main spool is at an intermediate position between said neutral position and said first pressurized fluid supply position;

a first check valve disposed in said first flow passage;

a second flow passage formed in said main spool and located so as to establish fluid communication between said second actuator port and said second load pressure detecting port when said main spool is at an intermediate position between said neutral position and said second pressurized fluid supply position;

a second check valve disposed in said second flow passage;

a check valve bore formed in said valve block;

a pressure reducing valve bore formed in said valve block;

a penetration bore formed in said valve block and extending between said check valve bore and said pressure reducing valve bore;

a fluid path formed in said valve block and extending between said check valve bore and said pump port;

a first port formed in an inner peripheral surface of said check valve bore;

a spool slidably disposed in said check valve bore for establishing and blocking communication between said first check valve port and said fluid path;

a second port formed in an inner peripheral surface of said pressure reducing valve bore;

a third port formed in an inner peripheral surface of said pressure reducing valve bore;

a spool slidably disposed in said pressure reducing valve bore and including a rod, wherein said spool and said pressure reducing valve bore defining a first pressure chamber and a second pressure chamber in communication with said third port; and a spring for biasing said pressure reducing valve bore spool is a given direction so as to cause said rod to extend into said penetration bore and engage an end surface of said check valve bore spool, wherein said valve spool disposed in said check valve bore is biased into a blocking position.

* * * * *